US009225079B2

(12) United States Patent
Fredriks

(10) Patent No.: US 9,225,079 B2
(45) Date of Patent: Dec. 29, 2015

(54) SURFACE MOUNT KEYHOLE CONNECTORS

(71) Applicant: Zierick Manufacturing Corporation, Mount Kisco, NY (US)

(72) Inventor: Ronald Fredriks, Pine Plains, NY (US)

(73) Assignee: Zierick Manufacturing Corporation, Mount Kisco, NY (US)

( * ) Notice: Subject to any disclaimer, the term of this patent is extended or adjusted under 35 U.S.C. 154(b) by 37 days.

(21) Appl. No.: 14/100,670

(22) Filed: Dec. 9, 2013

(65) Prior Publication Data

US 2014/0170895 A1 Jun. 19, 2014

Related U.S. Application Data

(60) Provisional application No. 61/735,123, filed on Dec. 10, 2012.

(51) Int. Cl.
*H01R 12/71* (2011.01)
*H01R 4/24* (2006.01)
*H01R 43/26* (2006.01)

(52) U.S. Cl.
CPC ..... *H01R 4/2454* (2013.01); *H01R 12/718* (2013.01); *H01R 43/26* (2013.01)

(58) Field of Classification Search
CPC ..... H01R 12/57; H01R 4/24; H01R 4/26; H01R 12/716; H01R 24/54; H01R 12/712; H01R 4/2404
USPC ..... 439/392–419
See application file for complete search history.

(56) References Cited

U.S. PATENT DOCUMENTS

| | | | | | |
|---|---|---|---|---|---|
| 1,639,125 | A | * | 8/1927 | Benjamin | 439/313 |
| 2,175,987 | A | * | 10/1939 | Dodge | 439/490 |
| 2,738,479 | A | | 3/1956 | Gibson | |
| 3,854,114 | A | * | 12/1974 | Kloth et al. | 439/398 |
| 3,990,762 | A | | 11/1976 | Lemesle | |
| 4,037,905 | A | | 7/1977 | Lucas | |
| 4,046,446 | A | * | 9/1977 | Reavis, Jr. | 439/401 |
| 4,220,390 | A | * | 9/1980 | Cobaugh et al. | 439/401 |
| 4,261,629 | A | * | 4/1981 | Reynolds et al. | 439/82 |
| 4,327,956 | A | * | 5/1982 | Sitzler | 439/397 |
| 4,363,529 | A | * | 12/1982 | Loose | 439/82 |
| 4,854,889 | A | * | 8/1989 | Ohtsuka et al. | 439/395 |

(Continued)

FOREIGN PATENT DOCUMENTS

EP 352905 A2 * 1/1990 ..... H01R 4/24

*Primary Examiner* — Briggitte R Hammond
(74) *Attorney, Agent, or Firm* — Myron Greenspan Lackenbach Siegel LLP

(57) ABSTRACT

An SMT electrical keyhole connector includes a flat mounting portion for surface mounting on a PCB and two spaced contact portions each provided with an aperture in a shape of a keyhole that defines a longitudinal insertion axis and includes an upstream open region dimensioned to receive with clearance an insulated conductor having a metallic conductor generally having a diameter d1 surrounded by an outer insulation coating generally defining a diameter d2 and a downstream elongated slot formed by parallel opposing edges spaced from each other a distance h less than d1. Cutting edges cut or strip insulation off an insulated conductor. A retainer prevents a stripped conductor from moving upstream back into the open region to insure positive contact with the conductive wire or wires after the conductor is urged downstream into and is fully seated within the elongated slot.

19 Claims, 10 Drawing Sheets

(56) References Cited

U.S. PATENT DOCUMENTS

| | | | | |
|---|---|---|---|---|
| 6,126,476 | A * | 10/2000 | Viklund et al. | 439/404 |
| 6,151,221 | A * | 11/2000 | Van Lerberghe | 439/83 |
| 6,247,960 | B1 * | 6/2001 | Daoud | 439/417 |
| 6,379,198 | B1 * | 4/2002 | Arnett et al. | 439/404 |
| 6,616,476 | B1 * | 9/2003 | Moritz et al. | 439/404 |
| 6,741,453 | B1 * | 5/2004 | Aleardi et al. | 439/404 |
| 7,026,559 | B2 | 4/2006 | James | |
| 7,134,903 | B1 * | 11/2006 | Pavlovic | 439/404 |
| 7,186,132 | B2 | 3/2007 | Quintanilla | |
| 2006/0094283 | A1 | 5/2006 | James | |
| 2009/0117774 | A1 * | 5/2009 | Legrady et al. | 439/404 |
| 2009/0239409 | A1 * | 9/2009 | Bishop | 439/404 |
| 2012/0003850 | A1 * | 1/2012 | Bishop et al. | 439/78 |

* cited by examiner

FIG. 13
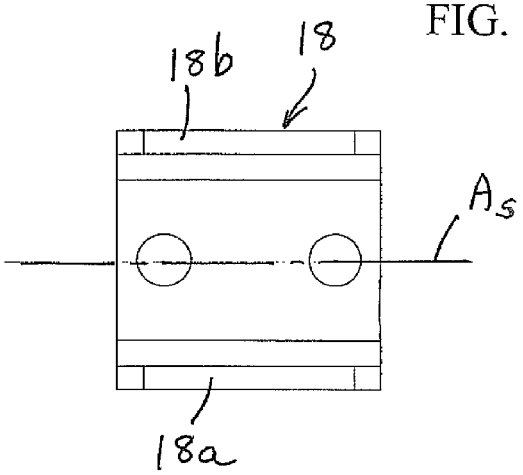
FIG. 12
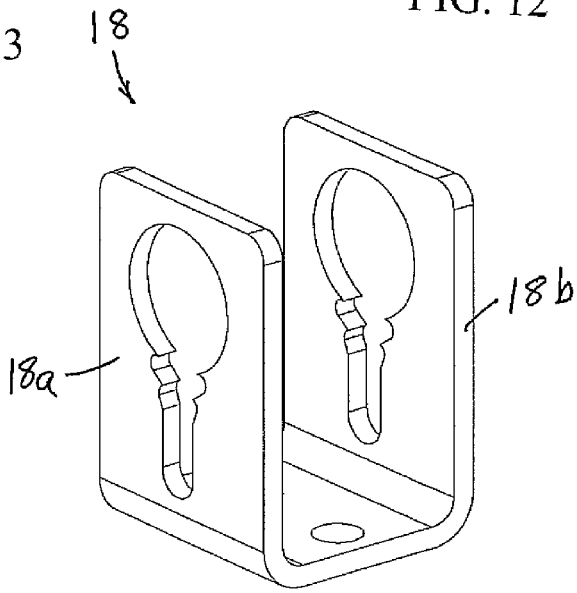
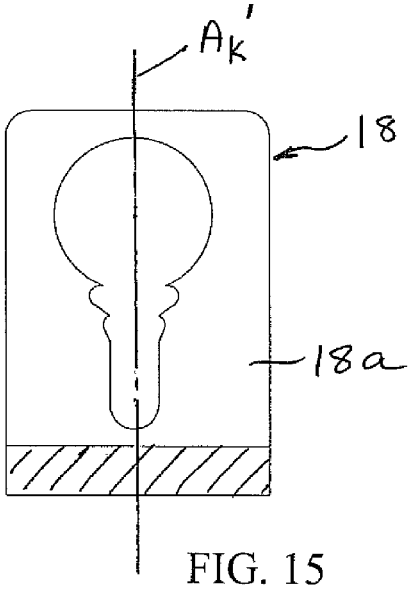
FIG. 15
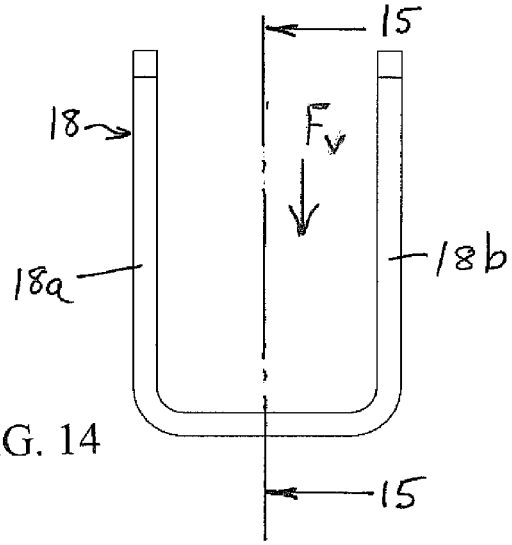
FIG. 14

FIG. 18
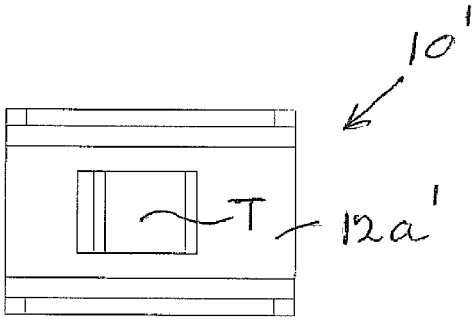
FIG. 16
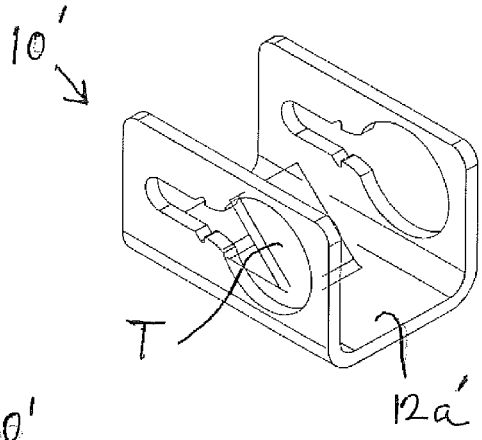
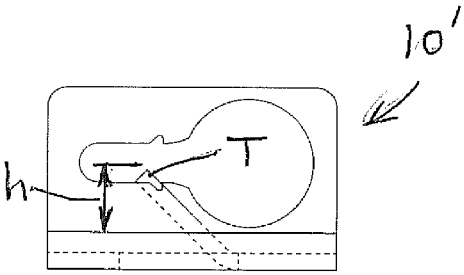
FIG. 17
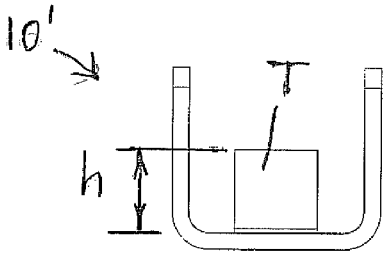
FIG. 19

FIG. 20
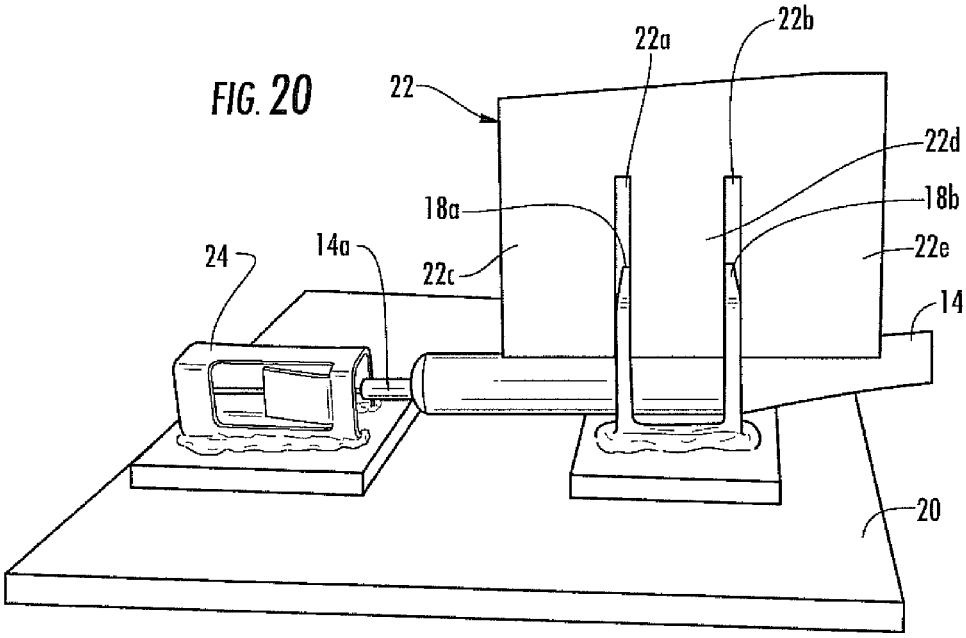
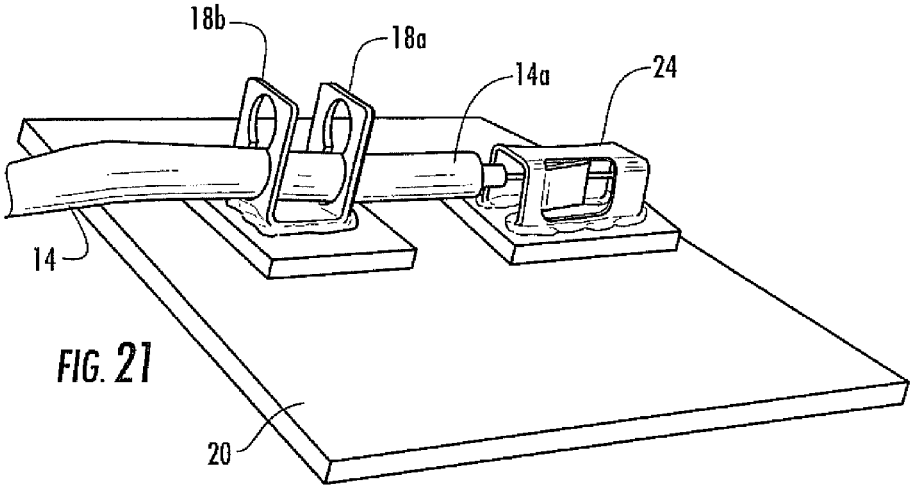
FIG. 21

SURFACE MOUNT KEYHOLE CONNECTORS

BACKGROUND OF THE INVENTION

1. Field of the Invention

The invention generally relates to surface mount connectors and, more specifically, to a keyhole surface mount connector.

2. Description of the Prior Art

Published Patent Application 20060094283 to James discusses a switch with insulation displacement connectors. The application discloses vertical keyhole connectors mounted on the body of a switch. The keyhole connectors include keyhole shaped openings that define a pair of parallel tines that straddle a slot. A slight edge being suggested, for example, in the keyhole connector 16 where the larger upper, generally circular opening transitions into the lower vertical slot. However, while the application shows a keyhole shaped connector there is no pronounced cutting barb or any other edge irregularities that perform multiple functions. U.S. Pat. No. 7,026,559, also issued to James, contains a similar switch construction as disclosed in the published '283 application.

Quintanilla U.S. Pat. No. 7,186,132 discloses an electrical and electronic connector that includes keyhole openings. This patent also suggests a modest cutting edge as the larger opening transitions to the elongated slot into which a cable is ultimately forced into. A lever is used to urge buttons to advance the wires to their desired positions. However, neither the published application to James nor the Quintanilla patent teach or suggest keyhole connectors that can be surface mounted on printed circuit boards nor multi-function edge irregularities.

U.S. Pat. No. 6,616,4762 Moritz teaches and electrical plug-in connector formed as a sheet metal stamping including a keyhole connector formed of sheet metal and folded as shown to provide two spaced keyhole contacts. However, the flat portions appear to be recessed and arranged in an electrical plug connector of the type shown that would prevent surface mounting. Additionally, this patent, as the previous ones, teaches what appears to be a modest cutting edge at the transition point where the larger circular opening meets the elongated slot.

U.S. Pat. No. 4,037,905 to Lucas discloses a no-strip electrical connector including an aperture and a slot. This connector also discloses a simple modest cutting edge at the transition point. While the conductive members have a generally flat outer base there is no teaching that the connector is surface mountable. Nor does the patent teach, as the previous references failed to teach, cutting barbs that project inwardly into the space at the transition points and optional additional surface or edge irregularities or features provided on the opposing edges of the longitudinal slots that perform additional functions such as enhancing contact and retaining the conductors in place after insertion.

An electrical connector, electrical terminal and a method of making electrical connection are disclosed in U.S. Pat. No. 3,990,762 issued to Lemesle. This patent, as well, teaches a keyhole connector. While the transition points appear to provide a somewhat sharp edge these appear to be curved or rounded. In other respects, the keyhole connectors shown this patent share common features with the other prior art connectors. There is no teaching nor suggestion that the keyhole connectors disclosed in this patent are capable of being surface mountable.

U.S. Pat. No. 2,738,479 to Gibson discloses a plural wire stripper and electrical connector. This patent teaches a pair of sidewalls that appear to be inwardly tapered in the direction away from the larger opening. The keyhole connector disclosed in this patent, therefore, shares the same features as in the other patent references, none of which teaches such connectors designed to be surface mounted nor provided with edge features, at and beyond the transition points, that are useful in stripping insulations, making contact with electrical connectors and ensuring that secure mechanical and electrical connections are maintained over time.

SUMMARY OF THE INVENTION

Accordingly, it is an object of the present invention to provide a surface mount keyhole electrical connector that does not have the disadvantages or limitations inherent in prior art keyhole connectors.

It is another object of the present invention to provide a surface mount keyhole electrical connector as in the previous objects that is simple in construction and inexpensive to manufacture.

It is still another object of the present invention to provide a surface mount electrical connector that is suitable for surface mounting on a printed circuit board.

It is yet another object of the present invention to provide a surface mount electrical connector as in the previous objects that can reliably strip or remove insulation to expose the electrical conductors within the insulated conductors after the contact has been surface mounted on a printed circuit board.

It is a further object of the present invention to provide a surface mount keyhole electrical connector that can be used to electrically and mechanically terminate an insulated conductor.

It is still a further object of the present invention to provide a surface mount keyhole electrical connector of the type under discussion that is suitable for terminating both single insulated conductors as well as coaxial cables that include metallic shields.

It is yet a further object of the present invention to provide a surface mount keyhole electrical connector that can be used with an inline box surface mount connector for mechanically and electrically terminating both the shielded portion of a coaxial cable as well as the center conductor thereof.

It is an additional object of the present invention to provide a surface mount electrical connector that can be used with a suitable insertion tool for moving an insulated conductor from a position in which the insulation is not yet displaced to a location in which the insulation is displaced, stripped or removed to expose the conductive wire or strands to provide contact with the conductive portions of the conductor.

It is still an additional object of the present invention to provide a surface mount keyhole electrical connector as in the previous objects in which keyhole apertures are provided that extend along insertion directions that are either parallel or perpendicular to the circuit board.

In order to achieve the above objects, as well as others that will become evident to those skilled in the art, a surface mount electrical keyhole connector comprises a generally flat mounting portion suitable for surface mounting on a printed circuit board (PCB) and at least one contact portion generally normal or perpendicular to said flat mounting portion, said at least one flat contact portion being provided with an aperture generally in a shape of a keyhole that defines a longitudinal axis and includes an upstream open region dimensioned to receive with clearance an insulated conductor having a metallic conductor generally having a diameter d1 surrounded by an outer insulation coating and a downstream elongated slot formed by generally parallel opposing edges substantially parallel to said axis of symmetry and spaced from each other a distance h that is less than said diameter d1, said generally circular and opposing edges meeting at intermediate transitions points where said enlarged upstream open region transitions with said downstream elongated slot. The edges at said transition points form insulation cutting means for cutting or stripping insulation off an insulated conductor. Retaining means are provided for retaining a conductor forced into said downstream elongated slot to prevent an insulated conductor from moving upstream back into said upstream open region, said opposing edges of said elongated slot downstream of said transition points serving to make positive contact with the conductive wire or wires within an insulated conductor after the conductor is urged downstream into and is fully seated within said elongated slot.

BRIEF DESCRIPTION OF THE DRAWINGS

Those skilled in the art will appreciate the improvements and advantages that derive from the present invention upon reading the following detailed description, claims, and drawings, in which:

FIG. 12 is a perspective view of an alternate embodiment of the keyhole connector shown in FIG. 1 in which the keyholes within the opposing parallel lateral sides of the connector are oriented generally vertically transverse or perpendicular to the base portion and printed circuit board on which the connector is to be mounted;

FIG. 13 is a top plan view of the connector shown in FIG. 12;

FIG. 14 is an end elevational view of the connector shown in FIGS. 12 and 13;

FIG. 15 is a cross-sectional view of the connector shown in FIG. 14, taken along the line 15-15 in FIG. 14;

FIG. 16 is a perspective view of a further alternate embodiment of the keyhole connector in accordance with the invention;

FIG. 17 is a side elevational view of the keyhole connector shown in FIG. 16;

FIG. 18 is a top plan view of the connector shown in FIGS. 16 and 17;

FIG. 19 is an end elevational view of the connector shown in FIGS. 16-18;

FIG. 20 is a top perspective view of a coaxial cable similar to the shown in FIGS. 6-8, showing the coaxial cable being forced downwardly to engage its outer metallic shield with the connector and, also showing a surface mount box connector mounted on the same printed circuit board proximate to the keyhole connector for terminating and making mechanical and electrical contact with the center conductor of the coaxial cable;

FIG. 21 is a perspective view of a coaxial cable after it has been urged into and is seated downstream within the keyhole connector slots to provide contact with the outer metallic shield of the coaxial connector and the in-line surface mount box connector makes contact with the center conductor of the coaxial cable;

DESCRIPTION OF PREFERRED EMBODIMENT

Figure 1:
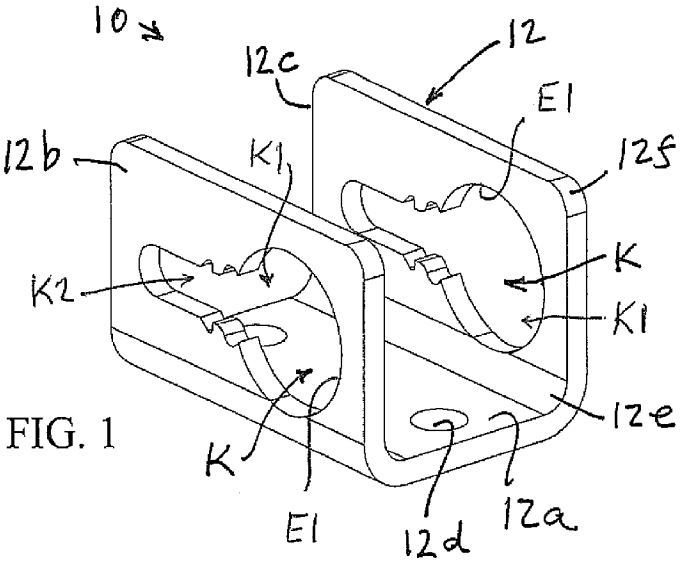
FIG. 1 is a perspective view of a first embodiment of a surface mount keyhole connector in which the keyholes are arranged generally horizontally along a direction generally parallel a base portion and to a printed circuit board on which the connector is surface mounted.
Figure 3:
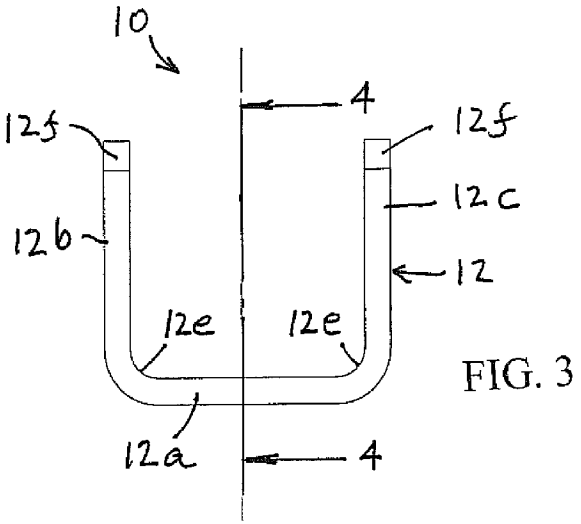
FIG. 3 is an end elevational view of the connector shown in FIGS. 1 and 2.

Referring specifically to the Figures, in which identical or similar parts are designated by the same reference numerals throughout, and first referring to FIGS. 1-4, a first embodiment of a keyhole connector is generally designated by a reference numeral 10.

Figure 2:
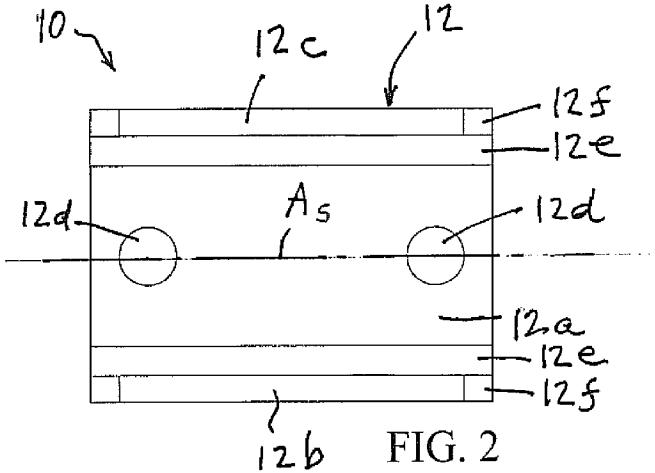
FIG. 2 is a top plan view of the connector shown in FIG. 1.

In accordance with the broader aspects of the invention an electrical keyhole connector suitable for surface mounting includes a generally flat mounting base portion 12*a* parallel to an of symmetry $A_s$ (FIG. 2) of the connector that corresponds to the insertion direction of the insulated wire or coaxial cable, as to be described. At least one contact portion, generally perpendicular or normal to the flat portion 12*a* is integrally funned therewith. However, in a currently preferred embodiment and in most applications, the connector 10 includes two flat spaced contact portions 12*b*, 12*c* that are integrally formed with the mounting base portion 12*a*. Preferably, the connector 10 is formed by die cutting or stamping a flat sheet of metallic material, then bent to provide rounded corners 12*e*, 12*f*. Holes 12*d* may be formed in the mounting base portion 12*a* to promote capillary action and adhesion of solder to the PCB during surface mounting by re-flow soldering or other soldering method. Therefore, the connector 10 generally has a generally uniform U-Shaped cross-section along the connector's longitudinal direction and axis $A_k$ of the connector (FIGS. 2 and 4).

Figure 4:
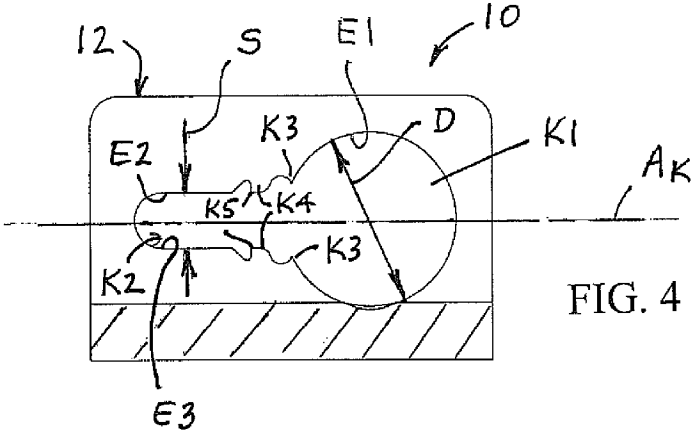
FIG. 4 is a cross-sectional view of the connector shown in FIG. 3 taken along line 4-4.
Figure 5:
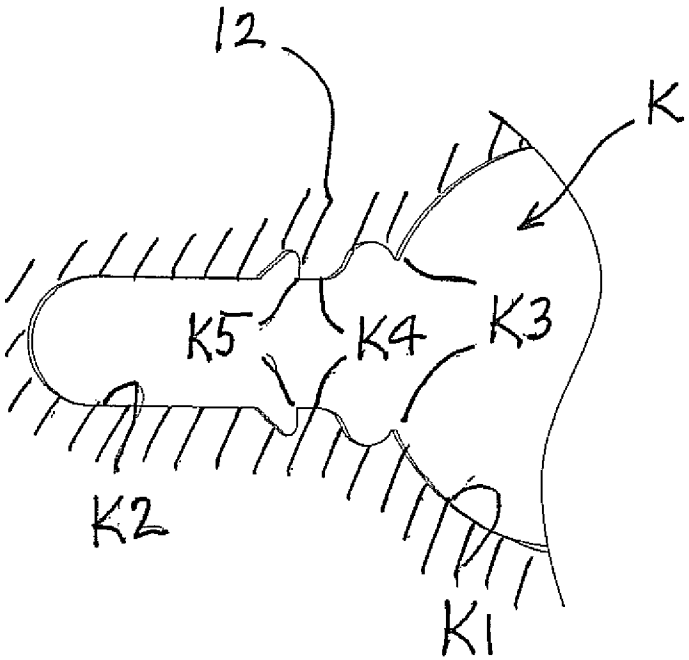
FIG. 5 is an enlarged representation of a keyhole shown in FIGS. 1 and 4 to better illustrate the details of the edge irregularities formed on opposing edges, generally in the regions of the transitions between the enlarged hole or circular region and the elongated slots of the keyhole opening.

Each contact portion 12*b*, 12*c* is provided with an aperture or opening K generally in a shape of a keyhole the axis of symmetry of which is generally parallel to the connector axis $A_k$ in the embodiment (FIG. 4). The axis of symmetry of each aperture K is generally parallel to the longitudinal axis $A_k$ of the connector and parallel to the mounting portion 12*a*. The aperture K has an upstream enlarged opening region K1 formed with an internal generally circular edge E1 having a predetermined diameter D (FIGS. 4-5). The region K1 is dimensioned to receive with clearance an insulated conductor having a metallic conductor surrounded by an outer insulation coating. Each aperture K is also provided with a downstream elongated slot K2 forming opposing generally parallel edges E2, E3 also parallel to the longitudinal connector axis $A_k$ and spaced from each other a distance S that is less than the predetermined diameter D.

The generally circular and opposing edges E1 and E2, E3 meet at intermediate transition points K3 where the enlarged opening region K1 transitions with the elongated slot K2. The transition points K3 form insulation cutting edges for penetrating the insulation and cutting and stripping the insulation off of an insulated conductor as it is forced from the circular region K1 to the elongated slotted region K2.

As best shown in FIG. 5, the opposing edges within the slotted region K2 are irregularly shaped to also form retaining hooks or barbs K5 downstream from the cutting tips K3 for engaging and retaining a conductor forced into the elongated slot to prevent the conductor from moving backwards or back upstream into the enlarged circular opening region K1. Between the cutting tips K3 and the retaining hooks or barbs K5 there are provided opposing edge portions K4 that protrude inwardly to form good contacts with the metallic conductors after the insulation has been stripped.

Figure 6:
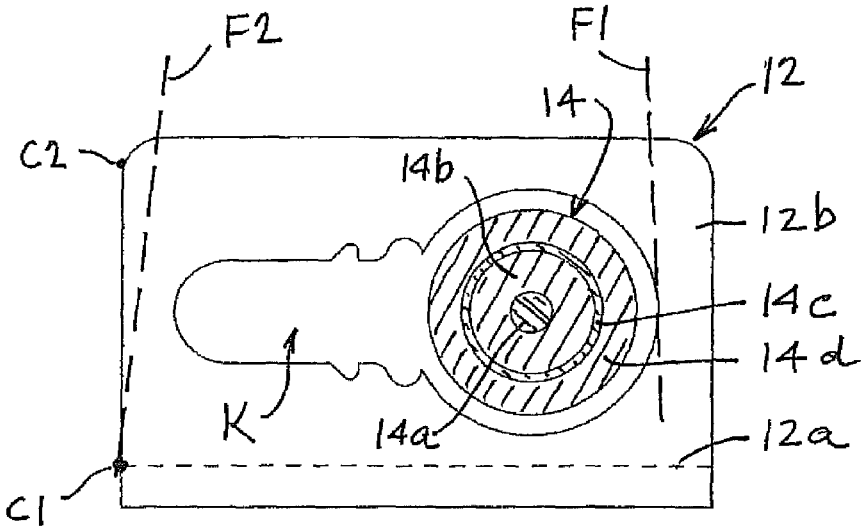
FIG. 6 is a side elevational view of the connector shown in FIGS. 1-4 with a coaxial cable received within the enlarged circular opening of the keyhole connector, and showing in dash-outline surfaces of a suitable tool, such as a modified duckbill pliers (two spaced slots are made along the inside surface of one jaw to straddle and engage the uprights or lateral contact portions 12*b* and 12*c* of the connector), for advancing the coaxial cable to its final downstream seated position.
Figure 7:
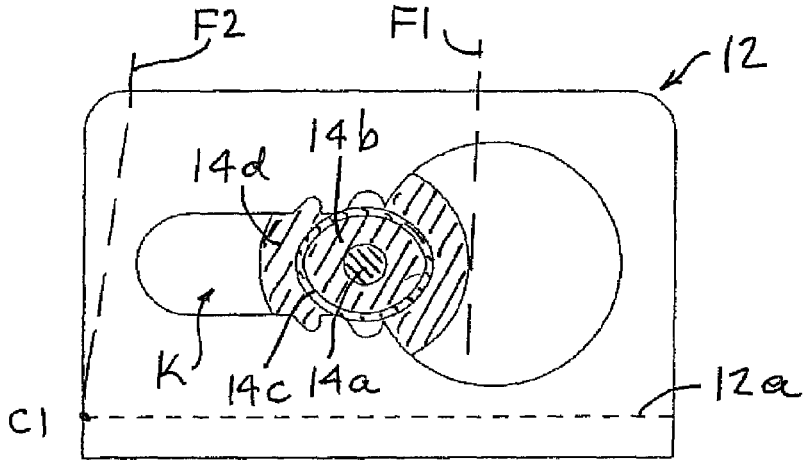
FIG. 7 is similar to FIG. 6 showing an intermediate position of the coaxial cable after the outer insulation of the coaxial cable has been cut, peeled or otherwise removed.
Figure 8:
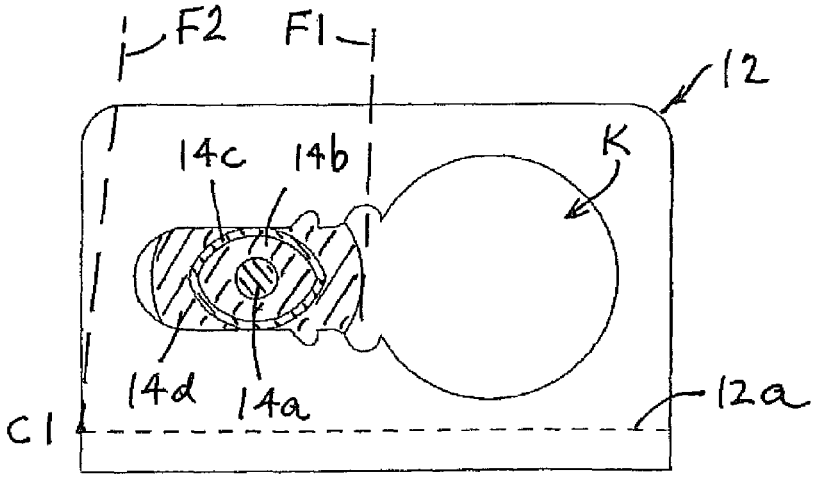
FIG. 8 is similar to FIGS. 6 and 7 but showing the coaxial cable in its restrained seated position in which the metallic shield makes contact with the connector while the center conductor remains electrically insulated or isolated from the metallic shield and the connector.

Referring to FIG. 6, a coaxial cable 14 is shown at an initial stage when inserted into a keyhole aperture. The coaxial cable 14 includes a center conductor 14*a* covered by an intermediate insulation layer 14*b*. A conductive shield, typically braided strands or metal foil 14*c* cover the intermediate insulation 14*b*. An outer insulation layer 14*d* coats and encloses the entire cable. As indicated, the diameter D of the circular region K1 is generally greater than the outer diameter of the coaxial cable so that the coaxial cable may be freely inserted into the circular region with some clearance. Once the connector is secured to the printed circuit board, a suitable tool such as a modified duckbill pliers having opposing faces F1, F2 (shown in phantom outline in FIG. 6) can be used to force the coaxial cable 14 into the narrower slot K2. The surface or face F1 of the pliers, for example, can engage in exterior surface portion of the coaxial cable while the other face F2 of the pliers can either engage contact point C1 or contact point C2 of the connector at the downstream end of the slot K2 so that closing the pliers and bringing the faces F1, F2 closer together while engaging the coaxial cable, the cable is urged into and forced downstream past the cutting edges K3 that cut or strip the insulation as shown in FIG. 7. Continued application of forces in the coaxial cable 14 forces it deeper downstream into the slot K2 where the opposing edges E2, E3 of the slot make contact with the conductive shield conductor layer 14*c* while the hooks or barbs K5 become embedded into the insulation 14*d* and prevent the coaxial cable from moving in the opposite direction (toward the right as viewed in FIG. 8) and returning into the enlarged area K1 where it may become dislodged. This permits the coaxial cable to move only in one direction, namely towards the downstream direction, or towards the left as viewed in FIGS. 6-8, where continued contact with the conductive shield is assured.

Figure 9:
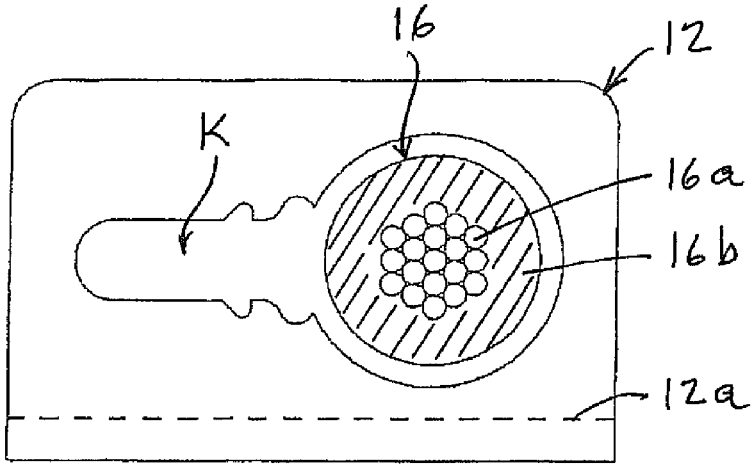
FIG. 9 is similar to FIG. 6 but shows an insulated conductor including a plurality of twisted or standard wires received within the enlarged opening upstream of the keyhole connector.
Figure 10:
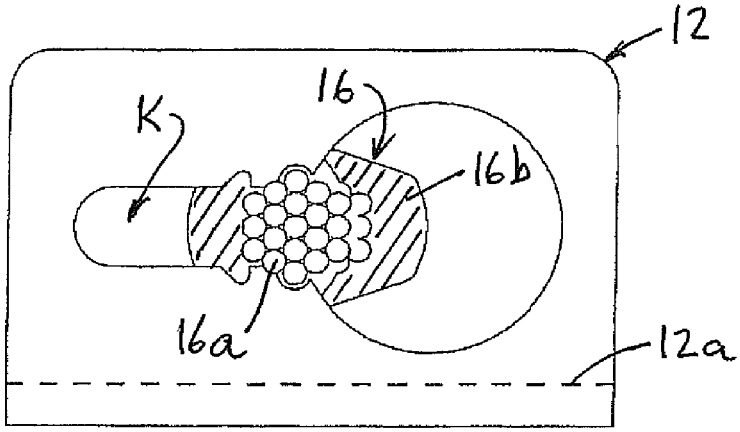
FIG. 10 is similar to FIG. 7 and shows an intermediate position in which the insulated conductor is urged downstream past the transition region in which the outer insulation is displaced and cut or stripped.
Figure 11:
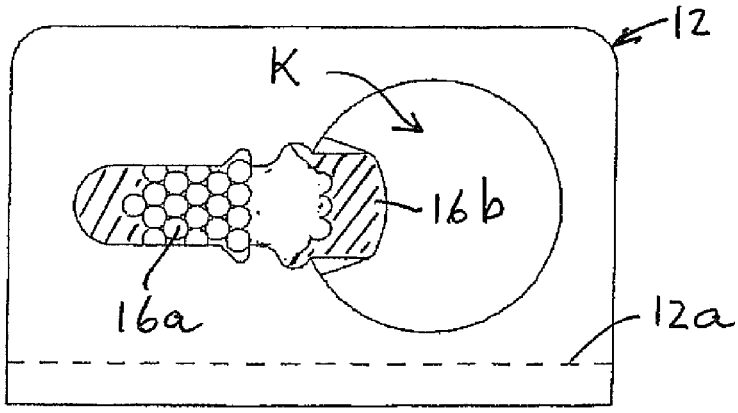
FIG. 11 is similar to FIG. 8 and shows the final seated downstream position of the insulated conductor in its restrained position in which the wire strands of the center conductor make contact with the opposing edges defining the downstream elongated slot of the keyhole connector.

Referring to FIGS. 9-11, an insulated conductor 16 with a single center conductor formed of stranded wires 16*a* is shown coated with an outer insulation layer 16*b*. Using the same or similar technique as discussed above in connection with FIGS. 6-8, the insulated conductor 16 is urged to move from the enlarged circular region K1 to the constrained slotted region K2 to provide reliable electrical and mechanical termination for the wire 16.

In order to assure that all the insulation proximate to the contact regions of the center conductors and/or conductive shields is removed and good electrical contact is assured the spacing between the opposing edges of the keyhole slots are reduced in relation to the anticipated diameters of the center conductors and the conductive shields, respectively. This dimensional reduction is exemplified in the following table:

Slot Reduction in Percent for Each Wire Size

| WIRE GAUGE | DIAMETER OF WIRE INCHES | SLOT OPENING INCHES | Δ INCHES | SLOT REDUCTION % |
|---|---|---|---|---|
| 16 | .051 | .038 | .013 | 25% |
| 18 | .040 | .032 | .008 | 20% |
| 20 | .032 | .028 | .004 | 13% |
| 22 | .025 | .022 | .003 | 12% |
| 24 | .020 | .016 | .004 | 20% |

The reduction should be by at least 0.010". The slot reduction should also be at least 10% of the conductor dimensions. Excessive reduction can damage the conductors. However, the maximum reduction should be 30% and optimal reduction should be in the range of 12-25%. A reduction of 20% provides an effective compromise to maintain the integrity of the conductors while insuring reliable contact between the conductors and the connectors. This also allows the same connectors to accommodate more than one AWG wire size.

Referring to FIGS. 12-15, an alternate embodiment of the surface mount keyhole connector is shown and designated by the reference numeral 18. The vertical keyhole connector 18 is provided with conductor receiving apertures and edge configurations between the enlarged circular regions and slotted regions similar to those discussed in connection with the horizontal keyhole connector 10. However, the keyhole apertures and the connector axis $A_k'$ (FIG. 15) are oriented in the vertical instead of the horizontal direction. Therefore, the vertical keyhole connector 18 functions similarly to the horizontal connector 10 and provides the same features, advantages and benefits thereof.

Referring to FIGS. 16-19, an alternate embodiment 10' of the connector shown in FIGS. 1-4 is shown in which a different mechanism is used for retaining an insulated conductor within the narrowed slot after the insulation has been stripped for preventing mechanical and/or electrical connection to be disrupted. Instead of using prongs, spikes or other protuberances that interact with the insulation and frictionally retain the conductor in place a resilient tab T is die-cut from the bottom base portion 12*a*' and is angularly offset a predetermined angle as shown. The tab T must project to height h (FIGS. 17, 19) sufficient to engage the captured conductor and provide an interference fit with the conductor once it is forced to its downstream-most position along direction $A_k$. To provide this retaining function the connector 10' should be formed of a spring steel or other resilient metal that allows the tab T to deflect when a wire is urged into the slot K2 and move back to block the conductor from moving out of the slot. Phosphor bronze, an alloy of copper, is a suitable metal for this purpose. Phosphor bronze is resistant to fatigue, wear and chemical corrosion. Other similar spring alloys can be used. Any other retaining means to keep the conductor within the slot K2 and to maintain electrical contact between the center conductor and the contact portions may be used.

Referring to FIGS. 20 and 21, a vertical keyhole connector 18 is shown surface mounted on a printed circuit board 20. While an insertion tool, such as a modified duckbill pliers can be used to insert the insulated conductors with the horizontal keyhole connectors 10, the vertical keyhole connectors 18 can be used with an insertion tool that applies a downward pressure $F_v$ on a cable as suggested in FIG. 14.

Referring to FIGS. 20, 21 the insertion tool 22 may be in the form of a slotted member provided with spaced slots 22*a*, 22*b* resulting in spaced tines 22*c*, 22*d* and 22*e*. The slots 22*a* and 22*b* are spaced to correspond to the spacing between the lateral contact portions 18*a*, 18*b* so that the latter may be received within the slots when the tool is lowered and downward pressure is applied on the cable.

FIG. 20 also shows a box connector 24 laterally spaced from the connector and mounted in-line from the conductor captured within the vertical keyhole connector 18 for engaging and terminating the center conductor 14*a* of a coaxial cable. The box connector may be identical or similar to the box connectors distributed by Zierick Manufacturing Corp. of Mount Kisco, N.Y., and sold as Part Numbers 1262/126219/6262/1262T/1262T/SRJ1262TH. By utilizing these two connectors in tandem and as shown both physical and electrical termination can be provided to both the center conductor 14*a* as well as the shielding conductor 12*d* of a coaxial cable. The box connector 24 can also be used in conjunction with the horizontal keyhole connector 10 described above.

Thus, a feature of one embodiment according to the invention is the provision of irregular edge configurations past the two sharp cutting edges where the insulation is cut or stripped. As the stripped wires (coax, solid or stranded) are pushed further, they are compressed between the groove opposing edges to make electrical contact as described. There is preferably a slight angle in the groove side walls to help drive the wire deeper into the slot as time goes on and not back out in a direction of the enlarged circular region.

The connector in accordance with the present invention can be defined as an insulation displacement connector (IDC) bypassing the need to strip the wires of insulation in a separate step prior to termination.

The surface mount connector in accordance with the present invention can be used, as noted, to mechanically and electrically terminate a coaxial cable or electrical wire without stripping the insulation. A lower wire insertion force is needed with this connector than with standard IDCs because of the two tandem step configuration, namely first cutting the insulation with sharp barbs for cutting just the insulation at the beginning of the groove then pushing the wire downstream to make the electrical connection. Conventional IDCs strip, cut and clamp the wires with the same blades and often dig into the metal wires causing higher insertion forces. With this invention a wire can be inserted from the side using a modified needle nose pliers rather than using special tool, pushing the wire from the top of the connector and compressing the PCB (printed circuit board). By tapering the walls of the groove the side walls connector has the feature of pushing the wire deeper into the connector rather than having the forces of the cutting blades backing up the wire. The retaining hooks or barbs (KS) at the beginning of the grooves also prevent the conductor from moving backwards. Finally, the keyhole connector 10, 18 can be plated, such as with gold and the wire contact area (slot edges) will only impart sliding friction of the wire wearing a plating. The standard IDC contact area plating can be worn away because the contact area will also be used for stripping the insulation, cutting into the wire or cutting strands of wire.

The first keyhole barbs cut into the wire approximately 0.005 inches, while stripping away the insulation. As the stripped wire proceeds into the keyhole slot, it conforms to the keyhole slot which is approximately 0.015 inches narrower than the wire diameter. This narrow passage conforms and compresses the wire in the slot to ensure good electrical contact.

The horizontal version of the keyhole connector provides wire insertion from the side with a pair of modified pliers while the vertical version requires an insertion tool that applies a downward force $F_v$ on the wire which will result in a compressive load on a circuit board. However, because most of the load is to displace the soft insulation the forces executed on the PCB can be controlled or limited to prevent damage to the board.

Figure 22:
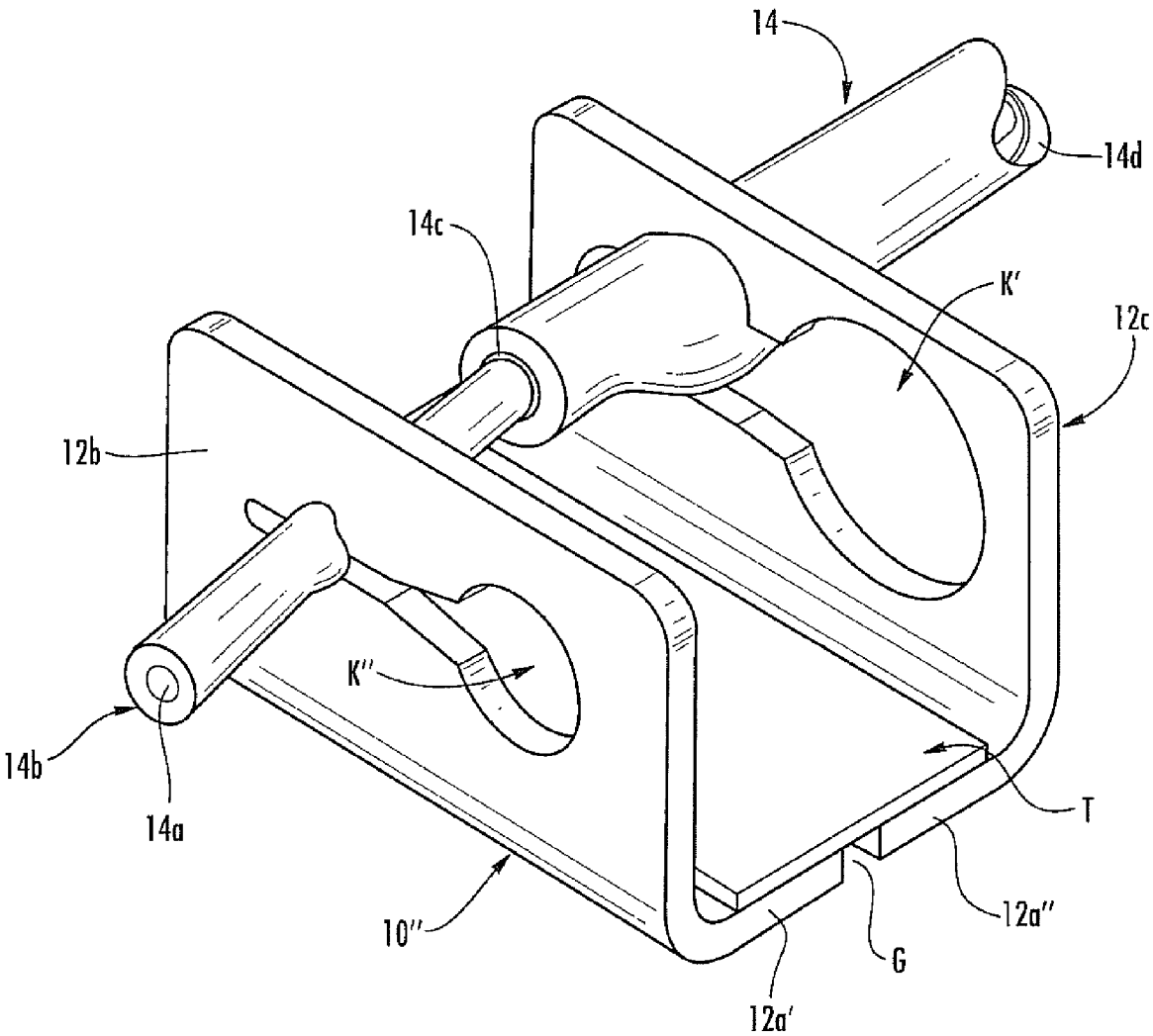
FIG. 22 is a perspective view of a modified keyhole connector with horizontal keyhole apertures for use with a coaxial cable not requiring a separate box connector.
Figure 23:
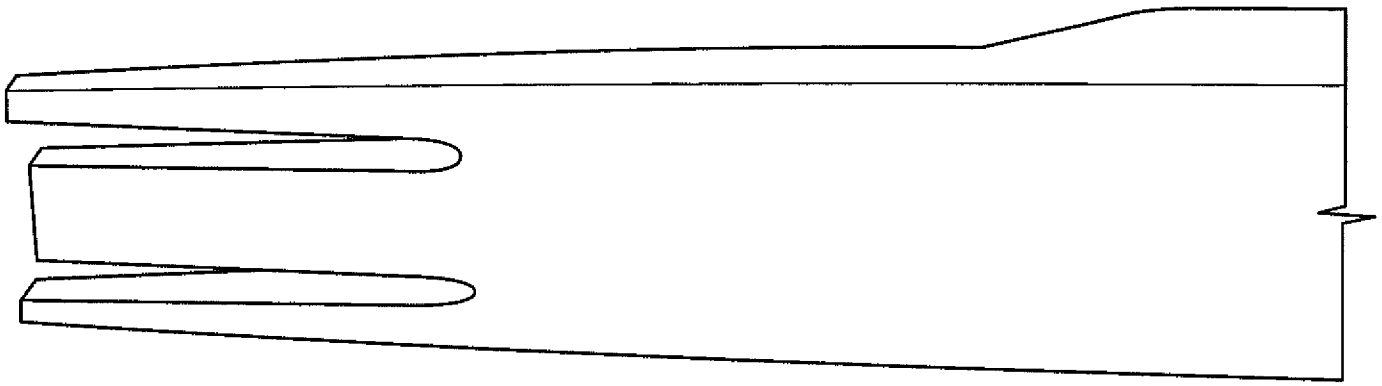
FIG. 23 is a top perspective view of an insertion tool that can be used to urge insulated conductors to be moved from the upstream open regions to the downstream elongated slots.
Figure 24:
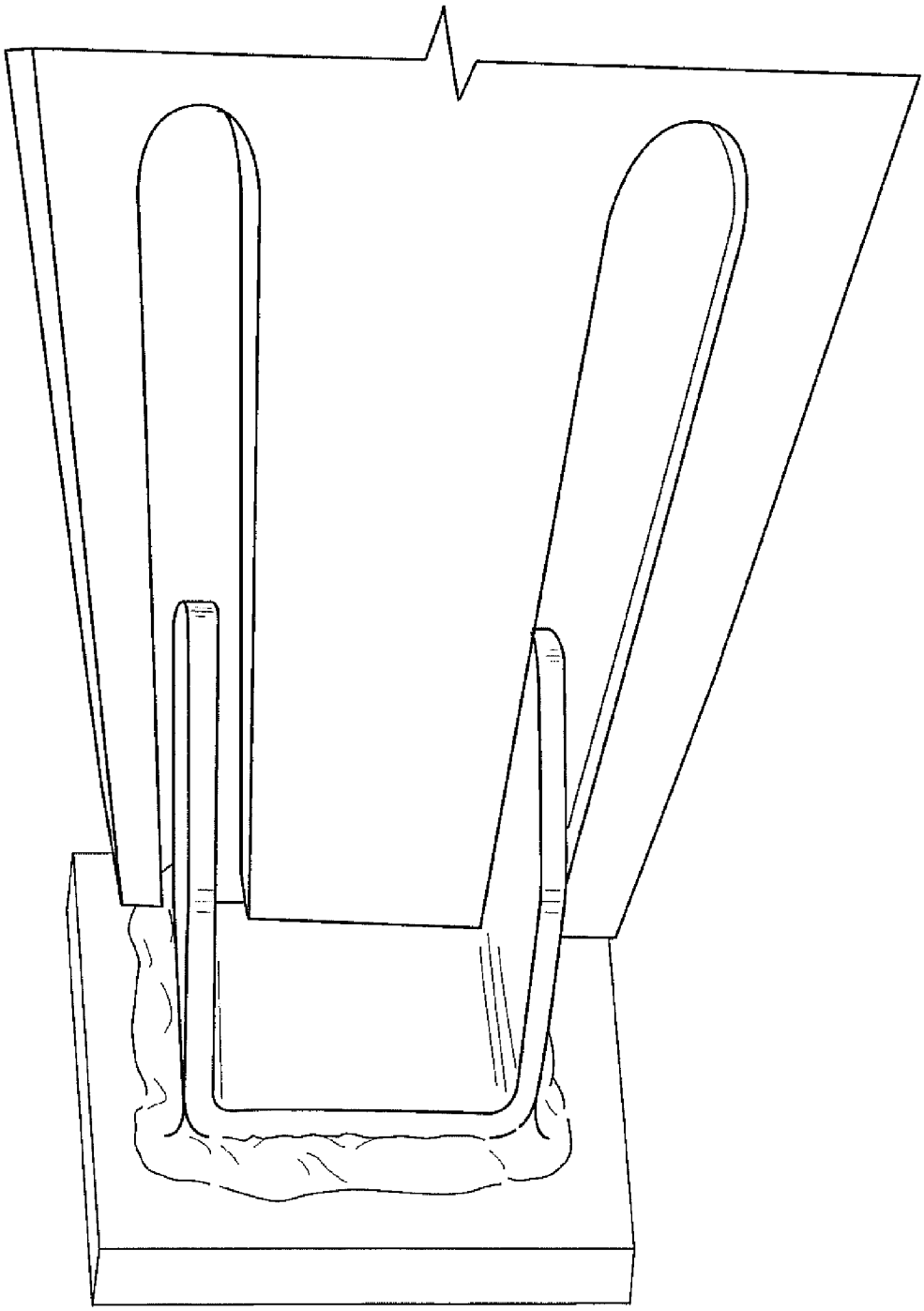
FIG. 24 is a top perspective view of the keyhole connector and the insertion tool shown in FIG. 22 in use to secure an insulated conductor to the connector.

Keyhole connectors 10" (FIG. 22) according to the invention can also be used with split connectors as disclosed in U.S. patent application Ser. No. 14/012,562 filed on Aug. 28, 2013 the contents of which is incorporated as if fully set forth herein. Thus, if the base portion is split by elongate gap G the base portions 12*a*' and 12*a*" each support another of the contact portions 12*b*, 12*c* which are, however, no longer in electrical contact and each of the base portions can now be mounted on another PCB pad or land (not shown) and be electrically isolated from each other. To maintain the physical connection and spacing between the contact portions a suitable tape T, such as Kapton™ tape, may be used to maintain the physical integrity of the connector while providing electrical insulation between the upright contact portions. With such modified connector the two opposing keyholes K', K", while generally vertically and horizontally aligned with each other the two keyholes are dimensioned to strip and engage both the outer conductive shield of a coaxial cable as well as the center conductor. By physically and electrically terminating both the conductive shield (whether foil or braid) and the center conductor it is no longer necessary to provide for other terminations such as the box connector discussed in connection with FIG. 20.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A surface mount electrical keyhole connector comprises a generally flat mounting portion suitable for surface mounting on a printed circuit board (PCB) and two contact portions that are generally parallel to each other and generally normal or perpendicular to said flat mounting portion, said at least one flat contact portion being provided with an aperture generally in a shape of a keyhole that defines a longitudinal axis and includes an upstream open region dimensioned to receive with clearance an insulated conductor having a metallic conductor generally having a diameter d1 surrounded by an outer insulation coating generally defining a diameter d2 and a downstream elongated slot formed by generally parallel opposing edges substantially parallel to said axis of symmetry and spaced from each other a distance h that is less than said diameter d1, said generally circular and opposing edges meeting at intermediate transitions points where said enlarged upstream open region transitions with said downstream elongated slot, said edges at said transition points forming insulation cutting means for cutting or stripping insulation off an insulated conductor, said opposing edges of said elongated slot downstream of said transition points serving to make positive contact with the conductive wire or wires within an insulated conductor after the conductor is urged downstream into and is fully seated within said elongated slot, wherein said mounting portion is split along its longitudinal length to break electrical continuity between said two contact portions.

2. A surface mount electrical keyhole connector as defined in claim 1, wherein keyhole apertures are provided in each contact portion generally aligned with each other.

3. A surface mount electrical keyhole connector as defined in claim 1, wherein one aperture in one mounting portion is dimensioned to securely receive a center conductor of a partially stripped coaxial cable to provide electrical contact therewith and a larger aperture in the opposing mounting portion to securely receive a coaxial cable to provide electrical contact with a metal shield of the coaxial cable, whereby the center conductor and metal shield remain electrically isolated when secured to the contact portions of the electrical connector.

4. A surface mount electrical keyhole connector as defined in claim 1, wherein said mounting and contact portions are integrally formed.

5. A surface mount electrical keyhole connector as defined in claim 1, wherein said flat mounting portion is provided with means for promoting attachment to a land on a printed circuit board when soldered thereto, said means for promoting attachment comprises at least one solder-receiving aperture through said mounting portion.

6. A surface mount electrical keyhole connector as defined in claim 1, wherein said mounting portion is a solid conductive portion to provide electrical continuity between said two contact portions.

7. A surface mount electrical keyhole connector as defined in claim 6, wherein the apertures in the opposing contact portions are dimensioned to securely receive a coaxial cable to provide electrical contact with a metal shield of the coaxial cable, in combination with a box connector generally aligned with said apertures and spaced from the keyhole connector for receiving a bear center conductor of the coaxial connector from which insulation has been stripped therefrom.

8. A surface mount electrical keyhole connector as defined in claim 1, wherein said split mounting portions are secured to each other in fixed positional relationships to each other by means of a non-conductive tape.

9. A surface mount electrical keyhole connector as defined in claim 8, wherein said tape is Kapton™ tape.

10. A surface mount electrical keyhole connector as defined in claim 1, wherein said mounting and contact portions are made of a substantially rigid conductive spring material.

11. A surface mount electrical keyhole connector as defined in claim 10, wherein said material is phosphor bronze.

12. A surface mount electrical keyhole connector as defined in claim 1, wherein said dimension h is reduced from the dimension d1 by a quantity selected within the range of 10-30%.

13. A surface mount electrical keyhole connector as defined in claim 12, wherein said range is selected to be within the range of 12-25%.

14. A surface mount electrical keyhole connector as defined in claim 12, wherein the reduction of h in relation to d1 is approximately 20%.

15. A surface mount electrical connector comprises a generally flat mounting portion suitable for surface mounting on a printed circuit board (PCB) and at least one contact portion generally normal or perpendicular to said flat mounting portion, said at least one contact portion being provided with an aperture that defines a longitudinal axis and includes an upstream open region forming a generally circular edge dimensioned to receive with clearance an insulated conductor having a metallic conductor generally having a diameter d1 surrounded by an outer insulation coating generally defining a diameter d2 and a downstream elongated slot formed by generally parallel opposing edges substantially parallel to said axis of symmetry and spaced from each other a distance h that is less than said diameter d1, said generally circular and opposing edges meeting at intermediate transitions points where said enlarged upstream open region transitions with said downstream elongated slot, said edges at said transition points forming insulation cutting means for cutting or stripping insulation off an insulated conductor, said opposing edges of said elongated slot downstream of said transition points serving to make positive contact with the conductive wire or wires within an insulated conductor after the conductor is urged downstream into and is fully seated within said elongated slots, wherein said retaining means comprises a resilient tab projecting from said flat mounting portion in the direction of said aperture to engage and retain a conductor received within an aperture.

16. A surface mount electrical connector comprises a generally flat mounting portion suitable for surface mounting on a printed circuit board (PCB) and at least one contact portion generally normal or perpendicular to said flat mounting portion to form a connector having a uniform cross-section in planes normal to said flat mounting portion, said at least one contact portion being provided with an aperture that defines a longitudinal horizontal axis generally parallel to said flat mounting portion and includes an upstream open region forming a generally circular edge dimensioned to receive with clearance an insulated conductor having a metallic conductor generally having a diameter d1 surrounded by an outer insulation coating generally defining a diameter d2 and a downstream elongated slot formed by generally parallel opposing edges substantially parallel to said axis of symmetry and spaced from each other a distance h that is less than said diameter d1, said generally circular and opposing edges meeting at intermediate transitions points where said upstream open region transitions with said downstream elongated slot, said edges at said transition points forming insulation cutting means for cutting or stripping insulation off an insulated conductor; said opposing edges of said elongated slot downstream of said transition points serving to make positive contact with the conductive wire or wires within an insulated conductor after the conductor is urged downstream into and is fully seated within said elongated slot, wherein a conductor inserted into said elongate slot can be urged from said upstream open region to said downstream elongated slot by applying a force on the conductor in a direction parallel to said longitudinal horizontal axis and generally parallel to said flat mounting portion, whereby a conductor can be secured to said connector without applying a force normal to said flat mounting portion when said contact is attached to a printed circuit board (PCB) thereby avoiding damage to the PCB.

17. A surface mount electrical connector comprises a generally flat mounting portion suitable for surface mounting on a printed circuit board (PCB) and at least one contact portion generally normal or perpendicular to said flat mounting portion to form a connector having a uniform cross-section in planes normal to said flat mounting portion, said at least one contact portion being provided with a closed aperture that defines a longitudinal axis and includes an upstream open forming a generally circular edge region dimensioned to receive with clearance an insulated conductor having a metallic conductor generally having a diameter d1 surrounded by an outer insulation coating generally defining a diameter d2 and a downstream elongated slot formed by generally parallel opposing edges substantially parallel to said axis of symmetry and spaced from each other a distance h that is less than said diameter d1, said generally circular and opposing edges meeting at intermediate transitions points where said circular upstream open region transitions with said downstream elongated slot, said edges at said transition points forming insulation cutting means for cutting or stripping insulation off an insulated conductor; said opposing edges of said elongated slot downstream of said transition points serving to make positive contact with the conductive wire or wires within an insulated conductor after the conductor is urged downstream into and is fully seated within said elongated slot, whereby the conductor can be inserted and retained within said closed aperture with substantially no elastic and no plastic deformation to thereby more evenly distribute normal forces and stresses on the conductor.

18. A surface mount electrical connector comprises a generally flat mounting portion suitable for surface mounting on a printed circuit board (PCB) and at least one contact portion generally normal or perpendicular to said flat mounting portion to form a connector having a uniform cross-section in planes normal to said flat mounting portion, said at least one contact portion being provided with a closed aperture that defines a longitudinal axis and includes an upstream open region forming a generally circular edge dimensioned to receive with clearance an insulated conductor having a metallic conductor generally having a diameter d1 surrounded by an outer insulation coating generally defining a diameter d2 and a downstream elongated slot formed by generally parallel opposing edges substantially parallel to said axis of symmetry and spaced from each other a distance h that is less than said diameter d1, said generally circular and opposing edges meeting at intermediate transitions points where said upstream open region transitions with said downstream elongated slot, said edges at said transition points forming insulation cutting means for cutting or stripping insulation off an insulated conductor; and retaining means in the form of protuberances along said opposing edges for retaining a conductor forced into said down downstream elongated slot, said opposing edges of said elongated slot downstream of said transition points serving to make positive contact with the conductive wire or wires within an insulated conductor after the conductor is urged downstream into and is fully seated within said elongated slot, whereby the conductor can be inserted and retained within said closed aperture by said opposing edges of said downstream elongated slot and prevented from moving upstream back into said upstream open region by said protuberances.

19. A surface mount electrical keyhole connector as defined in claim 18, wherein said protuberances comprise at least one pointed portion or spike arranged to frictionally engage an insulated conductor.

* * * * *